US005876293A

United States Patent [19]

Musty

[11] Patent Number: 5,876,293

[45] Date of Patent: Mar. 2, 1999

[54] GOLF PUTTER HEAD

[76] Inventor: David C. Musty, 2831 Junipero Ave. Suite 604, Signal Hill, Calif. 90806

[21] Appl. No.: 923,076

[22] Filed: Sep. 3, 1997

[51] Int. Cl.[6] ..... A63B 53/04

[52] U.S. Cl. ..... 473/341; 473/342; 473/343; 473/349

[58] Field of Search ..... 473/340, 341, 473/251, 342, 343, 344, 334, 335, 336, 337, 338, 339, 349, 329; 273/167 F, 169

[56] References Cited

U.S. PATENT DOCUMENTS

| | | | |
|---|---|---|---|
| D. 240,643 | 7/1976 | Manfrin | D34/5 GH |
| D. 240,644 | 7/1976 | Manfrin | D34/5 GH |
| 3,220,733 | 11/1965 | Saleeby . | |
| 3,226,120 | 12/1965 | Borah | 473/329 X |
| 3,516,674 | 6/1970 | Scarborough | 276/169 |
| 4,121,832 | 10/1978 | Ebbing | 273/171 |
| 4,324,404 | 4/1982 | Dian | 473/340 |
| 4,529,202 | 7/1985 | Jacobson | 473/335 X |
| 4,714,252 | 12/1987 | Roraback | 273/171 |
| 4,804,188 | 2/1989 | McKee et al. | 273/167 |
| 5,445,386 | 8/1995 | Marshall | 273/194 |
| 5,482,281 | 1/1996 | Anderson | 273/169 |
| 5,533,728 | 7/1996 | Pehoski et al. | 473/329 X |
| 5,575,472 | 11/1996 | Magerman et al. | 273/173 |
| 5,605,510 | 2/1997 | Schmidt et al. | 473/251 |
| 5,692,969 | 12/1997 | Schooler | 473/340 X |

FOREIGN PATENT DOCUMENTS

| | | |
|---|---|---|
| 2302761 | 10/1976 | France . |
| 2609164 | 9/1976 | Germany . |

*Primary Examiner*—Kien T. Nguyen
*Attorney, Agent, or Firm*—Fulwider Patton Lee & Utecht, LLP

[57] ABSTRACT

A golf putter head utilizing a dense, but yielding wooden impact bar that strikes a golf ball, with a pair of lead weights extending from the sides of the impact bar, and a shell enclosing the sides of the impact bar and the lead weights.

10 Claims, 3 Drawing Sheets

GOLF PUTTER HEAD

BACKGROUND OF THE INVENTION

The present invention relates generally to golf clubs and, in particular, to a golf putter head.

Conventional golf putter heads are generally formed entirely or primarily of metal which is cast or forged into various configurations. Because of the rigidity of such metallic construction, a golf ball when struck by a metal putter tends to hop upwardly relative to the ground and is often deflected off a desired line of putt when the ball returns to the ground. Golf putter heads utilizing wood are also marketed, as for example, the putter head in Anderson (U.S. Pat. No. 5,482,281). See also Roraback (U.S. Pat. No. 4,714,252). These putters include a body or shell which can be fabricated of wood and employing a metal sole. The positioning of the metal sole below the wood body places the center of gravity of the putter head below the equator of the golf ball. As a result, when struck by such a putter the golf ball hops off the ground and additionally backspin is imparted to the ball. As a result, the ball not only tends to move off its desired line of putt but it is also difficult to gauge the distance the ball will travel.

It is a further disadvantage of conventional prior art putter heads that when a golf ball is struck with an off-center stroke, the ball will not move along its desired line of putt towards the cup. This lack of accuracy results from the twist applied to the golf putter head by the off-center contact of the face of the putter head with the ball.

The golf putter head embodying the present invention overcomes the above-described disadvantages so as to increase the accuracy of a golfer's putt, both in direction, and in distance.

SUMMARY OF THE INVENTION

In a preferred embodiment of the golf putter head embodying the present invention, the head includes a centrally disposed impact bar formed of a dense, but yielding wood. To the heel and toe sides of the impact bar are affixed a pair of lead weights. The sides of the impact bar, and the lead weights are enclosed by a shell formed of wood. With this combination, contact of a golf ball with the front surface of the impact bar imparts a rolling action to the golf ball, rather than a hopping action, since the front surface of the impact bar deflects slightly inwardly as it imparts inertia to the ball. The pair of weights serve to centralize this inertia so as to assist the golfer in achieving a putt that is accurately controlled with respect to both direction and distance. Moreover, the inertia weighting system comprised of the impact bar and the lead weights cooperate to extend the "sweet spot" of the putter head across the width of the impact bar. Accordingly, accurate putts can be achieved even where the ball is struck off-center relative to the putter head. The impact bar and the shell may be formed of aesthetically appealing types of wood so as to provide a golf putter head having an attractive and unique appearance.

DESCRIPTION OF A PREFERRED EMBODIMENT

Figure 1:
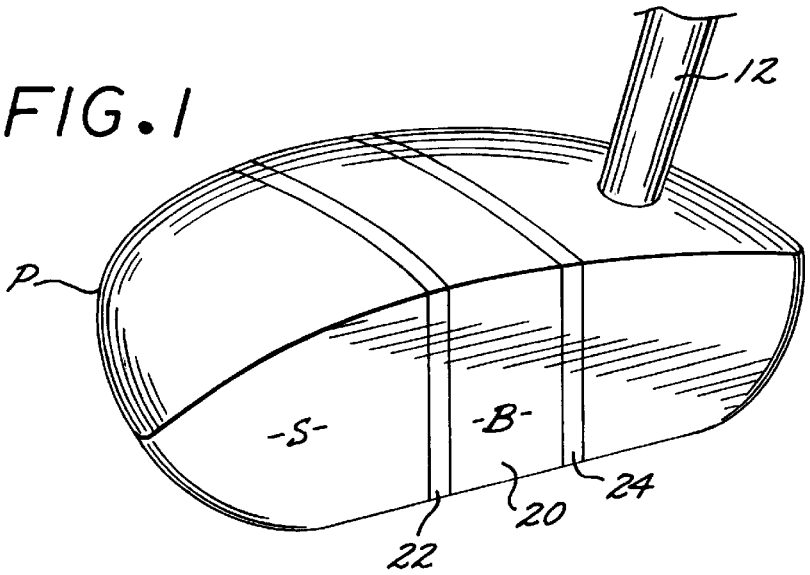
FIG. 1 is a perspective view of a preferred form of the golf putter head embodying the present invention.
Figure 2:
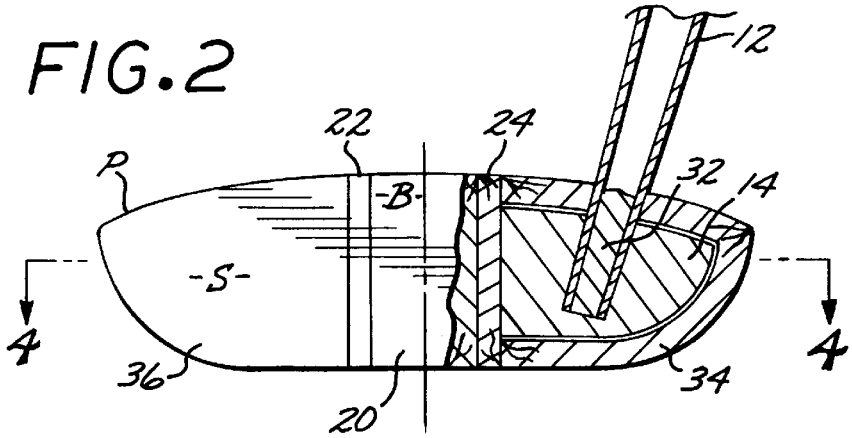
FIG. 2 is a front elevational view of such golf putter head, partly broken in section.
Figure 3:
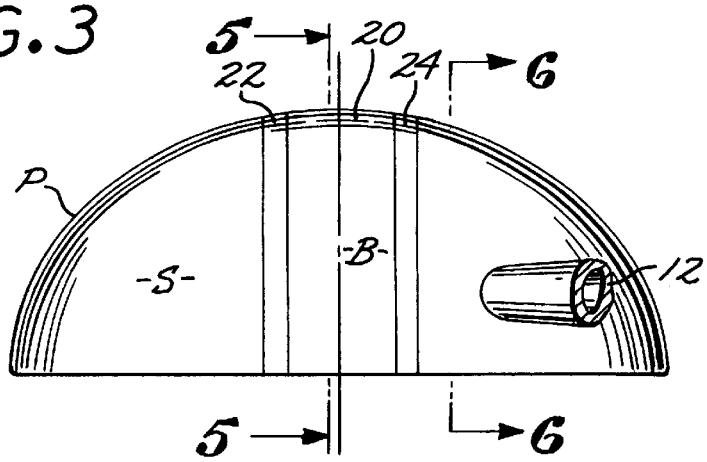
FIG. 3 is a top plan view of such golf putter head.
Figure 4:
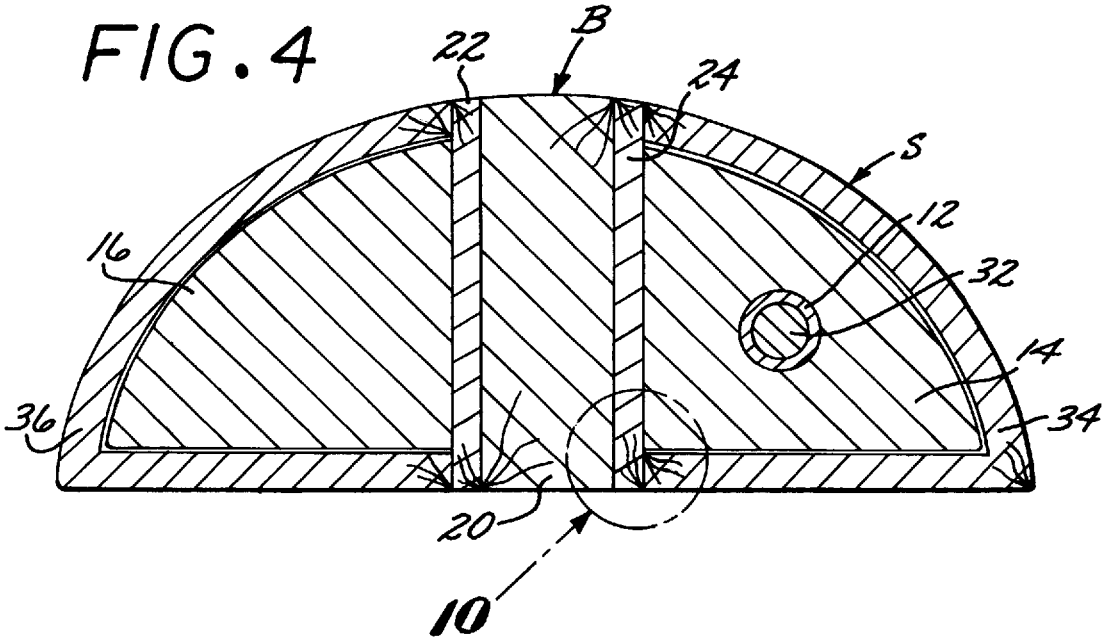
FIG. 4 is a horizontal sectional view taken in enlarged scale along line 4—4 of FIG. 2.
Figure 5:
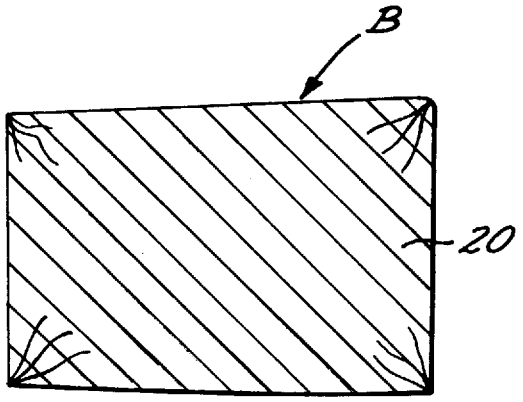
FIG. 5 is a vertical sectional view taken in enlarged scale along 5—5 of FIG. 3.
Figure 6:
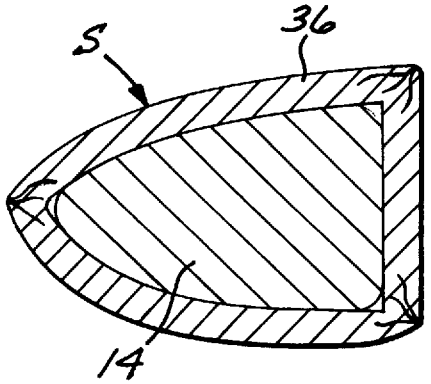
FIG. 6 is a vertical sectional view taken along line 6—6 of FIG. 3.

Referring to the drawings, a golf putter head P embodying the present invention is attached to a lower end of a shaft 12. A grip (not shown) is mounted on the upper end of shaft 12. The golf putter head P shown in the drawings is of the mallet type, however, other configurations may be utilized rather than that shown in the drawings. The golf putter head P includes an impact bar B formed of a dense, but yielding wood, to the opposite sides of which are adhered a pair of metallic weights (preferably lead), generally designated 14 and 16. The front face of impact bar defines a ball-striking surface 17. The impact bar B and lead weights 14 and 16 cooperate to form an inertia weighting system, shown particularly in FIG. 7. The sides of the impact bar B and the lead weights 14 and 16 are covered by a wooden shell S.

Figure 7:
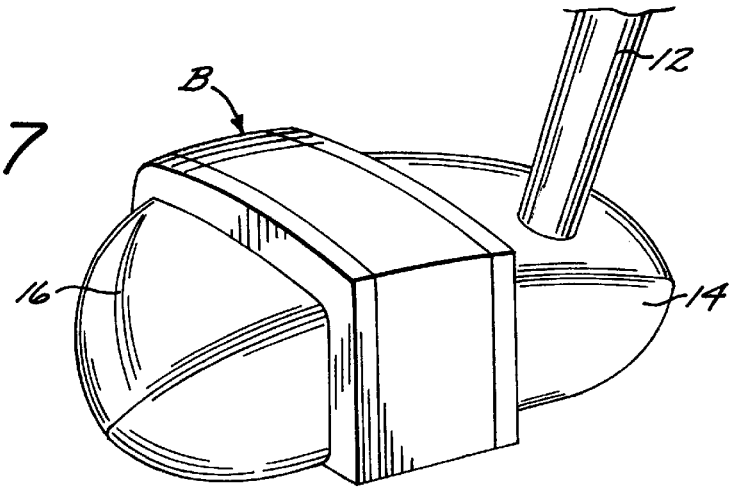
FIG. 7 is a perspective view showing the weighting system of said golf putter head.

More particularly, the impact bar 12 of FIGS. 1–7 consists of a centrally disposed ball striking block 20 formed of a wood such as maple, purple heart, rosewood or zebrawood. Other woods which will yield slightly when impacting a ball without denting may also be utilized. A pair of side plates 22 and 24 are firmly adhered to the opposite sides of ball striking block 20 as by epoxy. The side of ball striking block 20 proximate the golfer can be termed the "heel" side 26, while the opposite side can be termed the "toe" side 28. The lead weights 14 and 16 are rigidly adhered to and extend horizontally away from the heel and toe sides of the side plates 22 and 24 as by a resin. As indicated in FIG. 7 the lead weights have a generally wing-like appearance. The heel weight 14 is formed with an annular cavity 30 to receive the lower end of shaft 12, with the lower end of such shaft being rigidly adhered to such heel weight as by an epoxy. The heel and toe weights should be of approximately the same mass e.g. about 275 to 350 grams. Since a quantity of lead is removed from heel weight 16 to form the cavity 30 an appropriate amount of lead may be disposed within the lower portion of shaft 12, as indicated at 32, to compensate for the lead displaced by the cavity. The impact bar may weigh about 5 grams.

Figure 10:
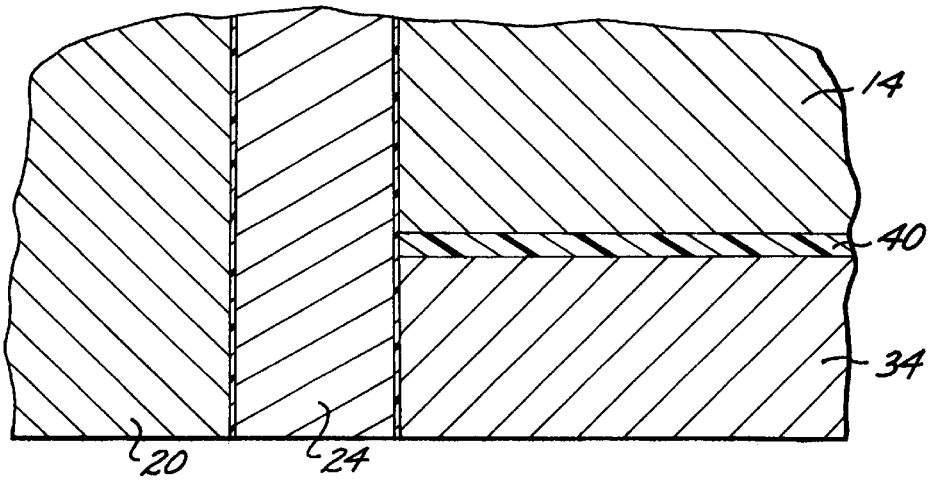
FIG. 10 is an enlarged view of the encircled area designated 10 in FIG. 4.

The shell S which covers heel and toe weights 14 and 16 is defined by a pair of routed-out wood pieces, e.q. a heel member 34 and toe member 36. The heel and toe members may be formed of woods such as oak, black walnut, cherry, rosewood or maple. The inner peripheral edges of each heel and toe member are rigidly adhered, as by an epoxy to the outer peripheral edge portions of the side plates 20 and 24. The side plates may be formed of woods such as those used to form the ball-striking block 20. The interior configuration of the heel and toe members will preferably be so configured to be telescopically received by the lead weights 14 and 16. A suitable adhesive 40 (FIG. 10) such as an epoxy or the like may be interposed within the space 42 separating the outer surfaces of the lead weights 14 and 16 and the interior surfaces of the shell members 34 and 36 so as to provide a firm and sound-deadening contact between the lead weights and the shell.

It should be noted that the color of the side plates 22 and 24 should be of a different color than the color of the ball striking block 20 and the shell S. Thus, if the ball striking block and shell are a light color, the side plates will be a dark color, and vice versa. With this arrangement the side plates will cooperate with the ball striking block and the shell to clearly define aiming lines for the golfer.

It should also be noted that the inertia weighting system shown particularly in FIG. 7 and comprising the impact bar B and its attached weights 14 and 16 centralize the inertia imparted to a golf ball during a putting stroke thereby permitting a golfer to accurately control the direction and distance of travel of the golf ball. Additionally, the lead weights resist the twisting action which occurs when a golf ball is struck off-center during a putting stroke so as to extend the effective width of the putter head across the width of the ball-striking surface 17 of the impact bar B. It has been found that satisfactory putts can be made using solely the inertia weighting system shown in FIG. 7. The shell S is provided in order to impart a conventional and aesthetically pleasing appearance to a finished putter of the present invention.

Figure 8:
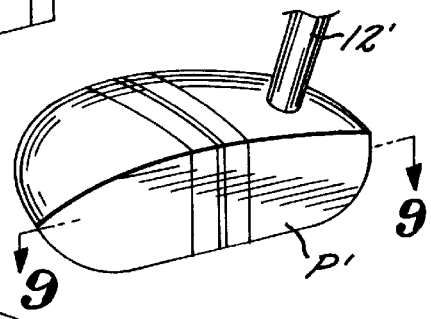
FIG. 8 is a reduced perspective view showing a second form of golf putter head embodying the present invention.
Figure 9:
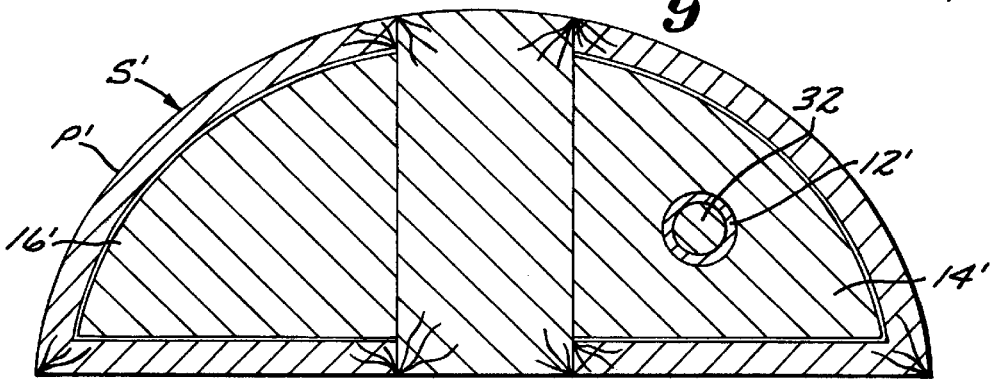
FIG. 9 is a horizontal sectional view taken in enlarged scale taken along line 9—9 of FIG. 8.

Referring now to FIGS. 8 and 9, there is shown a second form of golf putter head P' embodying the present invention. Such putter head P' is generally similar in construction and operation to the golf putter head P of FIGS. 1–7 and 10, with the exception that the impact bar B' is formed by a single block of dense wood, rather than the ball-striking block and side plates of FIGS. 1–7, and 10. A single aiming bar 50 can be centrally formed, as by paint, on impact bar B. Putter heads P and P' will preferably be coated with a clear watertight polyurethane (not shown).

The golf putter heads described hereinabove admirably achieve the advantages for which they are intended. It will be appreciated that various modifications and changes may be made by those skilled in the art without departing from the spirit and scope of the present invention.

I claim:

1. A golf putter head, for use with a golf shaft comprising;

an impact bar of a dense, but yielding wood having a front ball-striking surface, a heel side surface and a toe side surface opposite the heel side surface;

a first lead weight affixed to and extending horizontally away from the heel side surface of the impact bar;

a second lead weight affixed to and extending horizontally away from the toe side surface of the impact bar; and a wooden shell enclosing the sides of the impact bar and the lead weights.

2. The golf putter head of claim 1 wherein the first lead weight is formed with a cavity to received the golf club shaft.

3. The golf putter head of claim 2 wherein a quantity of lead is disposed within the lower end of the shaft to compensate for the weight displaced by the cavity.

4. The golf putter head of claim 2 wherein the impact bar includes a centrally disposed ball-striking block and a pair of side plates, one side plate being adhered to the heel side of the ball-striking block and the other side plate being adhered to the toe side of the ball-striking plate, with the side plates cooperating with the ball-striking block to define aiming lines.

5. The golf putter head of claim 1 wherein the lead weights are of approximately the same mass.

6. The golf putter head of claim 5 wherein a quantity of lead is disposed within the lower end of the shaft to compensate for the weight displaced by the cavity.

7. The golf putter head of claim 1 wherein the impact bar includes a centrally disposed ball-striking block and a pair of side plates, one side plate being adhered to the heel side of the ball-striking block and the other side plate being adhered to the toe side of the ball-striking plate, with the side plates cooperating with the ball-striking block to define aiming lines.

8. The golf putter head of claim 1 wherein impact bar comprises a single ball-striking block.

9. The golf putter head of claim 5 wherein a quantity of lead is disposed within the lower end of the shaft to compensate for the weight displaced by the cavity.

10. A golf putter head, for use with a golf shaft, comprising;

an impact bar having a front ball-striking surface, a heel side surface and a toe side surface opposite the heel side surface;

a first lead weight affixed to and extending horizontally away from the heel side surface of the impact bar;

a second lead weight affixed to and extending horizontally away from the toe side surface of the impact bar; and pair of hollow shells affixed to the opposite sides of the impact bar and enclosing the sides of the impact bar and the lead weights.

* * * * *